US005881530A

United States Patent [19]

Dykmans

[11] Patent Number: 5,881,530

[45] Date of Patent: Mar. 16, 1999

[54] METHOD AND APPARATUS FOR CONSTRUCTING PRESTRESSED STRUCTURES UTILIZING A MEMBRANE AND FLOATING DOME ASSEMBLY

[76] Inventor: Maximiliaan J. Dykmans, P.O. Box 966, El Cajon, Calif. 92022

[21] Appl. No.: 874,494

[22] Filed: Jun. 13, 1997

Related U.S. Application Data

[60] Division of Ser. No. 279,635, Jul. 22, 1994, Pat. No. 5,675,941, which is a continuation-in-part of Ser. No. 76,261, Jun. 11, 1993, abandoned, and a continuation-in-part of Ser. No. 12,986, Jan. 29, 1993, Pat. No. 5,408,793, which is a continuation of Ser. No. 782,436, Oct. 25, 1991, abandoned, which is a division of Ser. No. 477,715, Feb. 9, 1990, Pat. No. 5,094,044, which is a division of Ser. No. 206,849, Jun. 15, 1988, abandoned, which is a division of Ser. No. 559,911, Dec. 9, 1983, Pat. No. 4,776,145, said Ser. No. 76,261, is a continuation of Ser. No. 797,904, Nov. 26, 1991, abandoned, which is a continuation-in-part of Ser. No. 396,377, Aug. 21, 1989, Pat. No. 5,134,830, which is a continuation-in-part of Ser. No. 915,269, Oct. 3, 1986, Pat. No. 4,879,859, which is a continuation-in-part of Ser. No. 559,911, Dec. 9, 1983, Pat. No. 4,776,145.

[51] Int. Cl.[6] ..... E04B 1/32

[52] U.S. Cl. ..... 52/745.2; 52/741.4; 52/745.06; 52/745.07; 52/81.6; 52/2.15; 52/223.14; 264/32; 264/34

[58] Field of Search ..... 52/2.15, 81.6, 52/223.2, 223.3, 223.14, 245, 246, 745.01, 745.06, 745.07, 745.19, 745.2, 741.4; 264/32, 35, 313, 314, 316

[56] References Cited

U.S. PATENT DOCUMENTS

Re. 28,689 1/1976 Turner ..... 52/2.15 X
1,870,487 8/1932 Bitney .

(List continued on next page.)

FOREIGN PATENT DOCUMENTS 2490745 3/1982 France .
1052103 6/1952 Germany .

(List continued on next page.)

OTHER PUBLICATIONS

Max J. Dykmans; Summary of Structures, Designed, Built or Prestressed by BBR/Dyk; Revised Mar. 1986; pp. 1–11.
Max J. Dykmans; Cost Curves for Curcular Prestressed Concrete Storge Tanks; (2 pages).
Max J. Dykmans; Parade of Accomplishments; (8 pages).

(List continued on next page.)

*Primary Examiner*—Robert Canfield
*Attorney, Agent, or Firm*—Lyon & Lyon LLP

[57] ABSTRACT

The present invention is directed to improved tank or containment vessels and processes and apparatus for their construction. The tanks or containment vessels usually consist of circular walls resting on a base and a dome supported by the walls. The dome of the subject prestressed tank is formed by deploying or creating a membrane on the base, applying one or more layers of rigidifying material (and prestressing or reinforcing material if needed) on the membrane and then forming said membrane into a dome before the rigidifying material sets by the selective introduction of compressed air at appropriate locations between the base and the membrane. The hardening of the rigidifying material results in a composite preformed rigid roof or dome having a membrane liner and an overlay of composite construction. Once the walls are created, air pressure can be further utilized to raise this preformed composite dome upward to a predetermined height after which it is fastened to the walls. An appropriate air seal may be used to prevent excessive leakage of air between the walls and the dome and to assist in the raising of the dome. Utilizing this air cushion procedure to raise the dome to its proper location, eliminates the need of scaffolding and other costly support structures. Integral seismic anchors may be also used to complete the construction process to protect the structure against earthquakes and other tremors by anchoring the dome to the tank walls and the tank walls to the base in a manner whereby the seismic forces are translated parallel to the wall instead of radially to the wall.

64 Claims, 6 Drawing Sheets

U.S. PATENT DOCUMENTS

| | | | |
|---|---|---|---|
| 2,270,229 | 4/1942 | Neff . | |
| 2,335,300 | 11/1943 | Neff . | |
| 2,388,701 | 11/1945 | Neff . | |
| 2,413,243 | 3/1946 | Neff . | |
| 2,414,310 | 1/1947 | Laird . | |
| 2,833,593 | 5/1958 | Oliver . | |
| 2,836,529 | 5/1958 | Morriss . | |
| 2,892,239 | 6/1959 | Neff . | |
| 3,118,010 | 1/1964 | Harrington . | |
| 3,139,464 | 6/1964 | Bird et al. . | |
| 3,277,219 | 10/1966 | Turner . | |
| 3,315,343 | 4/1967 | Berg | 52/745.07 |
| 3,338,010 | 8/1967 | Waugh . | |
| 3,409,222 | 11/1968 | Gelin . | |
| 3,410,039 | 11/1968 | Brezina . | |
| 3,462,521 | 8/1969 | Bini . | |
| 3,504,474 | 4/1970 | Dykmans . | |
| 3,510,041 | 5/1970 | Dykmans . | |
| 3,557,515 | 1/1971 | MacCracken . | |
| 3,572,596 | 3/1971 | Dykmans . | |
| 3,616,070 | 10/1971 | Lemelson . | |
| 3,619,432 | 11/1971 | Harrington . | |
| 3,643,910 | 2/1972 | Heiftz . | |
| 3,666,189 | 5/1972 | Dykmans . | |
| 3,666,190 | 5/1972 | Dykmans . | |
| 3,676,976 | 7/1972 | McAllister . | |
| 3,719,341 | 3/1973 | Harrington . | |
| 3,765,605 | 10/1973 | Gusmer et al. . | |
| 3,769,763 | 11/1973 | Kwake . | |
| 3,801,009 | 4/1974 | Marshall, III . | |
| 3,824,751 | 7/1974 | Shelander . | |
| 3,892,367 | 7/1975 | Dykmans . | |
| 3,906,700 | 9/1975 | Fujiwara et al. | 52/747 |
| 3,914,077 | 10/1975 | Lodes . | |
| 3,922,426 | 11/1975 | Feltzin . | |
| 4,077,177 | 3/1978 | Boothroyd et al. . | |
| 4,102,956 | 7/1978 | Heifetz . | |
| 4,126,976 | 11/1978 | Crowley . | |
| 4,155,967 | 5/1979 | South et al. . | |
| 4,170,093 | 10/1979 | Capellini et al. . | |
| 4,226,677 | 10/1980 | Saito et al. . | |
| 4,271,647 | 6/1981 | Balck, Jr. . | |
| 4,289,564 | 9/1981 | Hanaford et al. . | |
| 4,302,978 | 12/1981 | Dykmans . | |
| 4,302,979 | 12/1981 | Dykmans . | |
| 4,307,554 | 12/1981 | Morrison et al. . | |
| 4,317,317 | 3/1982 | Kilts et al. . | |
| 4,320,075 | 3/1982 | Neilson . | |
| 4,321,776 | 3/1982 | Delight . | |
| 4,365,455 | 12/1982 | Braine . | |
| 4,372,733 | 2/1983 | Tinning et al. . | |
| 4,442,059 | 4/1984 | Boyce . | |
| 4,446,083 | 5/1984 | Nicholls . | |
| 4,468,412 | 8/1984 | Fujii et al. . | |
| 4,493,286 | 1/1985 | Carson . | |
| 4,514,471 | 4/1985 | Sugimoto et al. . | |
| 4,550,544 | 11/1985 | Thoeny . | |
| 4,588,541 | 5/1986 | Fowler . | |
| 4,593,360 | 6/1986 | Cocks . | |
| 4,628,861 | 12/1986 | Mitchell . | |
| 4,629,592 | 12/1986 | Harrington et al. . | |
| 4,642,856 | 2/1987 | Harrington . | |
| 4,696,133 | 9/1987 | Wren et al. | 52/81.6 |
| 4,776,145 | 10/1988 | Dykmans . | |
| 4,879,859 | 11/1989 | Dykmans . | |
| 4,884,747 | 12/1989 | Dykmans . | |
| 5,094,044 | 3/1992 | Dykmans . | |
| 5,134,830 | 8/1992 | Dykmans | 52/249 X |
| 5,408,793 | 4/1995 | Dykmans | 52/81.6 |
| 5,675,941 | 10/1997 | Dykmans | 52/81.6 |

FOREIGN PATENT DOCUMENTS

| | | |
|---|---|---|
| 2013337 | 9/1971 | Germany . |
| 2716325 | 10/1977 | Germany . |
| 2722984 | 11/1978 | Germany . |
| 3329296 | 2/1985 | Germany . |
| 22470 | 2/1979 | Japan . |
| 559009 | 9/1977 | U.S.S.R. . |
| 0596291 | 3/1978 | U.S.S.R. . |
| 715757 | 2/1980 | U.S.S.R. . |
| 761679 | 9/1980 | U.S.S.R. . |
| 776077 | 6/1957 | United Kingdom . |
| 815942 | 7/1959 | United Kingdom . |
| 938939 | 10/1963 | United Kingdom . |
| 2092215A | 8/1982 | United Kingdom . |

OTHER PUBLICATIONS

"Concrete Construction" Apr. 1988, vol. 33, No. 4, 22 pages Opportunities with inflated forming.

"Concrete International", Jan. 1986, vol. 8, No. 1, 27 pages including articles.

1988 Computer Search re Harrington Patents and Exchange of Correspondence.

A Pictorial Publication entitled: "Binishells Technology Pneumatically formed reinforced concrete structure" —4 pages.

Brochure entitled "The Dyk Igloo—Tomorrow's Technology at Yesterday's Prices".—2 pages.

A copy of the "AWWA Standard For Thermosetting Fiberglass—Reinforced Plastic Tanks" approved by the American National Standards Institute, Inc.

Two cover pages and p. 31 from the "Engineering Data for Aluminum Structures", Third Edition.

A Portion of the "Venus Products Catalog", Third Edition—Front page and pp. 16, 17, 20, 21, 24–25, 56, 57.

Catalogs from the "Hercules" Company—14 pages.

Catalogs for the "Kab–O–Rap Company"—25 pages.

Brochure entitled "Tankinetics" copyrighted in 1975, Justin Enterprises Inc.—pp. 1–8.

J.J. Closner, "Slip Forms Raise Big Prestressed Tank", Aug. 1958, pp. 72–75 of Construction Methods and Equipment.

Max J. Dykmans; What is Wrong with Local General Contractors Building Prestressed Concrete Tanks?; pp. 1–11 (Brochure).

Max J. Dykmans; Summary of Publications (A Pictorial Review of Brochures and Publications).

Max J. Dykmans; 1981 P.C.A. Award Winner (Brochure 1 page).

Max J. Dykmas; The Dyk III Tank Machine—Another Technological Breakthrough (Brochure–1 page).

Max J. Dykmans; Another Dyk Bar Stressing System (Brochure—1 page).

Max J. Dykmans; The Dyk Strand Winner brochure—pp. 1–4.

Max J. Dykmans; The Dyk II Strand–Winder Brochure—1 page.

Max J. Dykmans; Dyk–Vogt Wire Wrapping and Shotcreting Machine Brochure—1 page.

Max J. Dykmans; Automated Shotcrete & Sandblast Brochure—1 page.

Max J. Dykmans; Dyk Flat Steel Wrapping for Water & Sewage Tanks Brochure—1 page.

Max J. Dykmans; 1983 P.C.A. Award Winner/ 7 Mg Reservoir, Salt Lake City, Utah; 1 page.

Max J. Dykmans; 1984 P.C.A. Award Winner 2–6 Mg Reservoirs, Cerritos, California 1 page.

Max J. Dykmans; 5 Mg Reservoir, Loveland, Colorado 1 page.
Max J. Dykmans; City of Everett Water Reservoir #6 1 page.
Max J. Dykmans; 1.6 Mg Reservoir, Newport Beach, California 1 page Brochure.
Max J. Dykmans; 40 Million Gallons of Prestressed Concrete Storage 1 page.
Max J. Dykmans; 2 Mg Reservoir, San Clemente, California 1 page Brochure.
Polymer Composites Incorporated brochure relating to composite materials Oct. 11, 1988.
Polymer Composites Incorporated brochure "Filament Winding with Fiberod Thermoplastic Ribbon" Jun. 7, 1993.
Brochure "The Dyk–6 Concept" Aug. 1, 1993.
Brochure "Typical PC Machinery and Tanks".
Brochure "The Dyk 6 Tank" Mar. 18, 1994.
Publication "Composition News: Infrastructure" Issue No. 3, Mar. 18, 1994.

METHOD AND APPARATUS FOR CONSTRUCTING PRESTRESSED STRUCTURES UTILIZING A MEMBRANE AND FLOATING DOME ASSEMBLY

This is a division of application Ser. No. 08/279,635 filed Jul. 22, 1994, now U.S. Pat. No. 5,675,941, which is a continuation-in-part ("C.I.P.") of applications Ser. No. 08/012,986 filed Jan. 29, 1993, now U.S. Pat. No. 5,408,793 and Ser. No. 08/076,261 filed Jun. 11, 1993, now abandoned, Ser. No. 08/012,986 is in turn a continuation of Ser. No. 782,436 filed Oct. 25, 1991, now abandoned which is a divisional of 477,715 filed Feb. 9, 1990 (issued as U.S. Pat. No. 5,094,044) which is a divisional of Ser. No. 206,849 filed Jun. 15, 1988, now abandoned, a divisional of Ser. No. 559,911 filed Dec. 9, 1983 which issued a U.S. Pat. No. 4,776,145. Ser. No. 08/076,261 is a continuation of Ser. No. 07/797,904 filed Nov. 26, 1991, now abandoned, which is a continuation-in-part of Ser. No. 396,377 filed Aug. 21, 1989 (issued as U.S. Pat. No. 5,134,830) which is a C.I.P. of Ser. No. 915,269 filed Oct. 3, 1986 (issued as U.S. Pat. No. 4,879,859) which is a C.I.P. of Ser. No. 559,911 filed Dec. 9, 1983, now U.S. Pat. No. 4,776,145.

BACKGROUND OF THE INVENTION

This application represents a continuous evolution of the subject inventor's inventive technology relating to prestressed tanks or containment vessels. The field of the invention is containment structures and their construction which structures can be used to hold solid,liquids or gases. This invention is particularly useful in the construction of domed structures, utilizing a membrane and circumferential prestressing.

There has been a need for the improved construction of these types of structures as conventional construction has proven difficult and costly. Furthermore, these structures generally do not lend themselves to automation. For example, the current practice has been to construct roofs or domes of such tanks on scaffolding, shoring, framing or decking which is quite costly and time consuming, in contrast to the invention claimed herein where the roof is prefabricated and raised on a cushion of air.

Certain of these conventional structures have utilized prestressed concrete, reinforced concrete or steel tank construction, which are discussed below. Others have utilized Fiber Reinforced Plastic (FRP) and some have utilized inflated membranes.

Turning first to prestressed concrete tanks, their construction have typically utilized prestressing and shotcreting applied by methods set out in detail in U.S. Pat. Nos. 3,572,596; 4,302,978; 3,869,088; 3,504,474; 3,666,189; 3,892,367 and 3,666,190 issued to the subject inventor which are incorporated herein by reference. As set forth in these references, a floor, wall and roof structure is typically constructed out of concrete using conventional construction techniques. The wall is then prestressed circumferentially with wire or strand which is subsequently coated with shotcrete. The machinery used for this purpose is preferably automated, such as that set forth in the above patents. Shotcrete is applied to encase the prestressing and to prevent potential corrosion. As set out in more detail in these patents, and particularly U.S. Pat. No. 5,094,044, which is incorporated herein by reference, prestressing is beneficial in that concrete is not very good in tension but is excellent in compression. Accordingly, prestressing places a certain amount of compression on the concrete so that the tensile forces caused by the fluid inside the tank are countered not by the concrete, but by the compressive forces exerted on the concrete by the prestressing materials. Thus, if design considerations are met, the concrete is not subjected to the substantial tension forces which can cause cracks and subsequent leakage.

Major drawbacks of the above prestressed concrete tank structure are the need for expensive forming of the wall and roof and for substantial wall thickness to support the circumferential prestressing force which places the wall in compression. Furthermore, cracking and imperfections in the concrete structure can cause leakage. Also, conventional concrete tanks are generally not suitable for storage of certain corrosive liquids and petroleum products.

We now turn to tanks constructed using regular reinforcing. This second major category of concrete tanks typically utilize regular reinforcing (in contrast to prestressing), and no membrane. These tanks are inferior to the tanks utilizing circumferential prestressing because, while regular reinforcing makes the concrete walls stronger, it does not prevent the concrete from going into tension, making cracking and leakage an even greater possibility. Typically, reinforcing does not come into play until a load is imposed on the concrete is structure. It is intended to pick up the tension forces because, as previously explained, the concrete cannot withstand very much tension before cracking. Yet reinforcing does not perform this task very well because, unlike circumferential prestressing which preloads the concrete, there are no prestressing forces exerting on the concrete to compensate for the tension asserted by the loading. Moreover, as compared to prestressed concrete tanks, these reinforced concrete tanks require even more costly forming of wall and roof, and even greater wall thicknesses to minimize tensile stresses in the concrete, problems greatly eliminated with the subject invention.

Turning now to inflated membranes, such membranes, have been used for airport structures where the structure consists of the membrane itself. Inflated membranes have also been used to form concrete shells wherein a membrane is inflated and used as a support form. Shotcrete, with or without reinforcing, is sometimes placed over the membrane and the membrane is removed after the concrete is hardened. Another form of this construction is exemplified by conventional "Binishell" structures. Information regarding such structures is in the Disclosure Statement and in U.S. Pat. No. 3,462,521. These structures are constructed by placing metal springs, and regular reinforcing bars over an uninflated lower membrane. Concrete is then placed over the membrane and an upper membrane is placed over the concrete to prevent it from sliding to the bottom as the inflation progresses. The inner membrane is then inflated while the concrete is still soft. After the concrete has hardened, the membranes are typically removed. A major drawback of the afore-described conventional structures is the high cost connected with reinforcing and waterproofing them for liquid storage. Moreover, with regard to the "Binishell" structures, because of the almost unavoidable sliding of the concrete, it is difficult if not impossible to avoid honeycombing of the concrete and subsequent is leaks. Also Bini does not teach the utilization of membranes in conjunction with circumferential prestressing, in contrast to using mere reinforcing. As a result, these structures have not been very well received in the marketplace and have not, thus far, displaced the more popular and commercially successful steel, reinforced concrete and prestressed concrete tanks and containment vessels. Substantial improvements to these types of membrane structures are set out in U.S. Pat. Nos.

4,879,959; 5,134,830; 4,776,145; 5,094,044 issued to the subject inventor which are incorporated by reference, but which do not accomplish the advantages of the subject invention.

Another general category of existing tanks are those made of fiberglass. These fiberglass tanks have generally been small in diameter, for example, in contrast to the prestressed or steel tanks that can contain as many as 30 million gallons of fluid. The cylindrical walls are often filament-wound with glass rovings. To avoid strain corrosion, (a not very well understood condition wherein the resins and/or laminates fracture, disintegrate or otherwise weaken) the tension in fiberglass laminates is typically limited to 0.001 in/in (or 0.1%) strain by applicable building codes or standards and by recommended prudent construction techniques. For example, the American Water Works Association (AWWA) Standard for Thermosetting Fiberglass, Reinforced Plastic Tanks, Section 3.2.1.2 requires that "the allowable hoop strain of the tank wall shall not exceed 0.0010 in/in." A copy of this standard is provided in the concurrently filed Disclosure Statement. Adhering to this standard means, for example, that if the modulus of elasticity of the laminate is 1,000,000 psi, then the maximum design stress in tension should not exceed 1,000 psi (0.001×1,000,000). Consequently, large diameter fiberglass tanks have required substantially thicker walls than steel tanks. Considering that the cost of fiberglass tanks has been close to those of stainless steel, another common type of tank, and considering the above strain limitation, there are not believed to have been any viable large diameter fiberglass tanks built worldwide since fiberglass became available and entered the market some 35 years ago. Another reason why large fiberglass tanks have not been viable, is the difficulty of operating and constructing the tanks under field conditions, water tanks, for example are often built in deserts, mountaintops and away from the pristine and controlled conditions of the laboratory. Resins are commonly delivered with promoters and catalysts for a certain fixed temperature, normally room temperature. However, in the field, temperatures will vary substantially. Certainly, variations from 32° F. to 120° F. may be expected. These conditions mean that the percent of additives for promoting the resin and the percent of catalyst for the chemical reaction, which will vary widely under those temperature variations, need to be adjusted constantly for the existing air temperatures. Considering that these percentages are small compared to the volume of resin, accurate metering and mixing is required which presents a major hurdle to on-site construction of fiberglass tanks, The above problems have been remedied to a great extent by the teachings of the undersigned inventor's U.S. Pat. Nos. 4,879,856; 5,134,830; 4,884,747; 5,076,495 and 5,092,522 which are hereby incorporated by reference, and regarding which the subject patent represents a further evolution and improvement. There have also been problems with seismic anchoring of the above tanks, some of which have been solved by the techniques and apparatus disclosed in Mr. Dykman's U.S. Pat. Nos. 5,105,590 and 5,177,919, which are also hereby incorporated by reference.

SUMMARY OF INVENTION

In a first aspect of the present invention, a prestressed tank is disclosed, with the dome formed by first deploying or forming a membrane on a base, placing rigidifying material and/or prestressing or reinforcing on the membrane as needed, allowing the same to harden after it has been shaped in the form of a dome by the selective introduction of air between the floor and the membrane (forming in effect a preformed dome), constructing the walls of a tank upon the base and around said preformed dome, and then raising or floating the pre-formed dome on a cushion of air by the use of compressed air pumped under the membrane. After the dome is raised to a predetermined height, it. is then anchored to the walls of the tank.

In another aspect of the subject invention, these tanks, which can be constructed at relatively low cost and are suitable for most liquids in sizes to 50 million gallons (MG)—include an advanced hybrid construction of a prestressed concrete (PC) wall and dome design with a light-cured fiber reinforced plastic (FRP) lining (or membrane) covering the floor and the inside surface of the walls and dome. These tanks can also be constructed with a FRP-AL (aluminum) floating roof—with a prefabricated FRP dome—or with a reinforced concrete (RC) FRP-lined flat slab roof supported by FRP-RC columns.

In another embodiment, a separate dome or lid can be manufactured using this same process of forming a membrane, using air to shape the membrane into a dome, placing rigidifying material placed thereon and allowing the same to harden forming a composite structure.

In one aspect of the invention, the walls are a composition of fiber reinforced plastic, concrete, shotcrete, regular reinforcing steel and circumferential prestressing.

In another aspect of the invention an outer membrane is used to protect the above construction from the elements.

In yet another aspect of the invention exterior or interior insulation is used to compensate for large temperature gradients.

In another aspect of the present invention, seismic countermeasures or anchors are used to protect the contemplated structure against earthquakes and other tremors. To eliminate instability or possible rupture, the tank walls are anchored to the base through seismic cans. The cans are substantially oriented in a radial direction in relation to the center of the structure, permitting the seismic forces to be taken in share by the seismic anchors. The walls of the structure are free to move in or out in the radial direction allowing the structure to distort substantially into an oval shape thereby minimizing bending moments in the wall. Thus, when a seismic disturbance occurs, the force acting on the structure can be transmitted and distributed to the footing parallel to and around the circumference of the tank.

In another aspect of the present invention, a floating roof is used to minimize combustible vapor between the roof and the liquid which may be subject to explosion. Typical tanks of this type are gasoline and jet fuel tanks.

In yet another aspect of the invention, using more accurate analysis and construction means set forth by this invention, the thickness of the walls can be substantially reduced and more easily constructed. The automated means of construction recommended, the automated rotating tower apparatus and the floating roof concept can substantially facilitate construction and decrease the costs for a large variety of tanks for water, sewage, chemicals, petrochemicals and the like.

The invention described herein provides an excellent example of how combining the strengths of FRP and PC can be used to construct structures with increased usefulness, liquid tightness and corrosion resistance. Prestressed concrete excels in structural performance whereas FRP excels in liquid tightness and corrosion resistance. The combination enables one to build very large tanks for an almost unlimited range of liquids, faster and cheaper than heretofore possible. This development has been the culmination of 40 years of experience in tank design and construction covering some 2 billion gallons of storage and 8 years of intensive development work.

BRIEF DESCRIPTION OF THE DRAWINGS

FIG. 6A shows the FRP floor membrane (100), which has been formed around the central column (118), with appropriate layers of rigidifying material laid thereon (135) before the setting of the same and before air has been introduced to shape it into the form of a dome.

FIG. 6B shows the membrane (100)/rigidifying material (135) composite structure after air has been used to shape it into a dome and after the rigidifying material has cured to create a preformed rigid roof. Air seals (106) between the roof (15) and the walls (104) are also shown to allow the dome to be raised or floated into its final position with air.

FIG. 6C shows the preformed dome roof (15) fastened in place near the top of the walls (104) after it was raised on a cushion of air and without the use of any scaffolding.

DETAILED DESCRIPTION OF THE PREFERRED EMBODIMENTS

Figure 1:
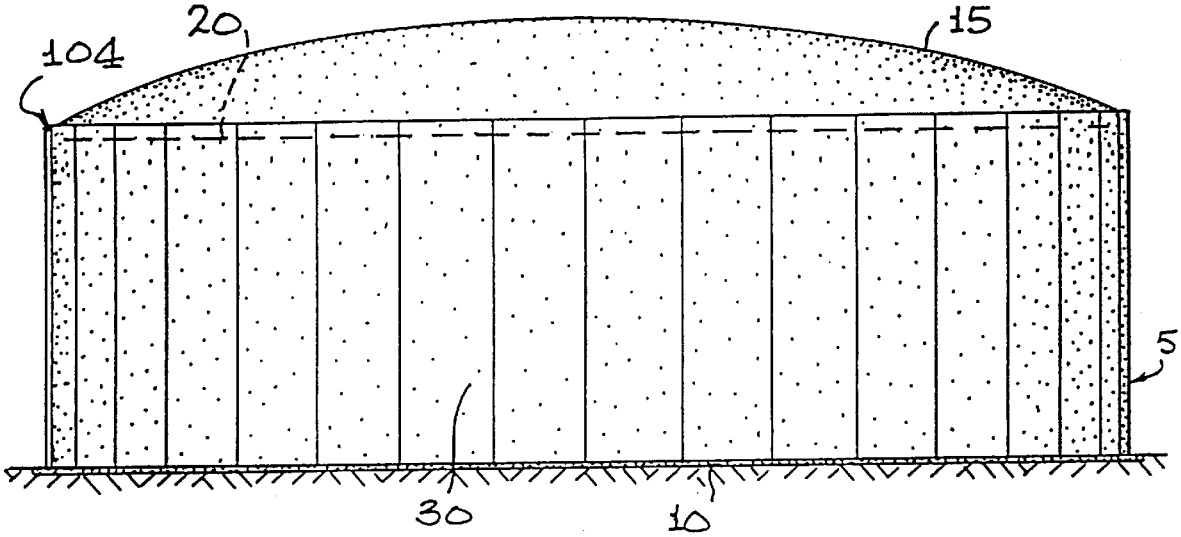
FIG. 1 shows an elevation view of a circular domed roof composite structure, containment vessel or tank which forms part of the subject invention.

FIG. 1 shows an elevation of a dome-roofed tank of the type constructed utilizing the novel methods and materials disclosed herein. Simply, walls (104) are seen resting on a pad (10) and also serve to support roof (15). On the assumption that his is a liquid holding tank, the high liquid level is shown by dotted line (20).

Figure 2:
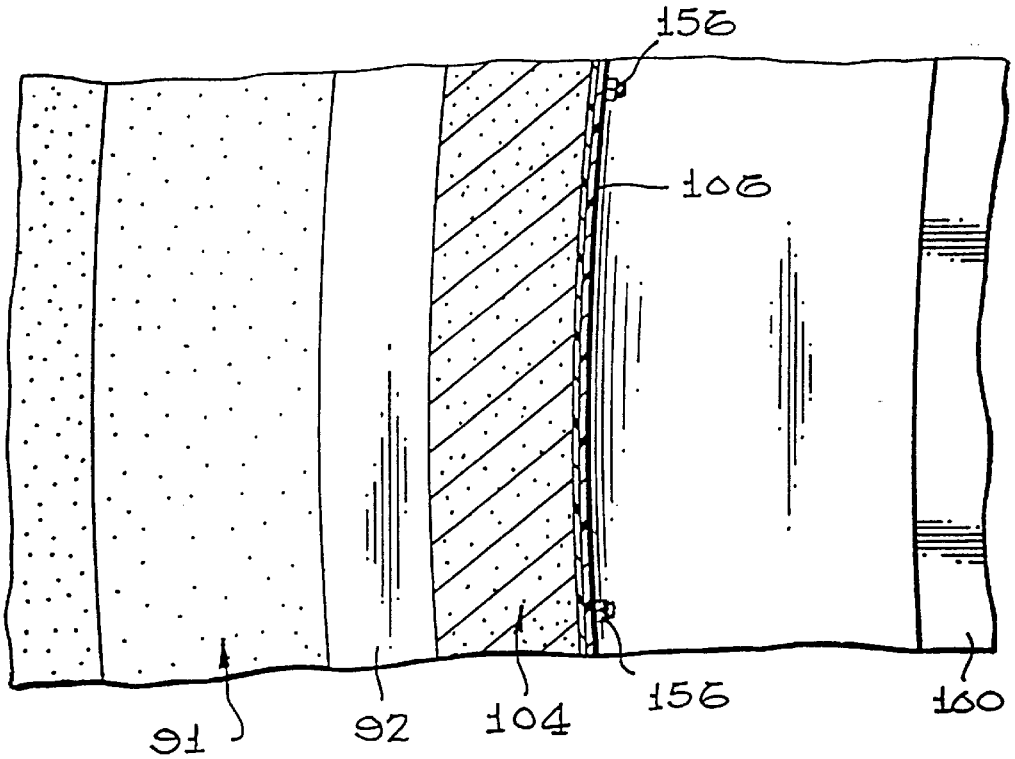
FIG. 2 shows a plan view of tank wall and wall-footing construction.

FIGS. 2 shows a plan view on wall and walls footing. In FIG. 2, the walls (104) are cylindrical in nature and of FRP-PC construction. A monolithic FRP floor (100) or membrane is constructed on a one-inch thick cement mortar leveling pad (102) and partially on the wall footing (91). The floor (100) is made up of a liner or membrane formed, in the best mode, of four one-sixteenth inch thick layers of relatively flexible double-bias knit glass fabric impregnated with high elongation light curable vinyl ester resins which cover the entire floor area inside of the tank, the underside of the wall and portion of the wall footing. The floor membrane can also be made of other materials. Floor 100 is preferably placed on two layers of ten mil (10 mil) polyethylene sheeting which covers the concrete levelling pad (102) and wall-footing (91). This allows the walls to slide inwardly in a radial direction (such as when prestressing takes place or the liquid level changes) in a more efficient manner and prevents the FRP from sticking to the floor. The resins can be cured by conventional UV-light curing type lamps and by mechanisms as discussed in part in U.S. Pat. No. 5,094,044 to Mr. Dykmans which is incorporated herein by reference. The walls (generally shown by number 104) are likewise constructed with an inner liner (106) or membrane made up of four sheets of one-sixteenth inch thick double-biased knit fabric with high elongation-type light curable vinyl ester resins on the inside. A double seal is preferably made between the floor (100) and wall lining (106) by an approximately 18" wide splice lining (93) on the inside and (92) on the outside (covering the floor and the wall up to about 18")—again made from 4 layers of double-bias knit glass fabric impregnated with high elongation-type light curable vinyl ester. The inside corner of wall and floor is further strengthened with a FRP core of the same glass/vinyl/ester construction.

Figure 3:
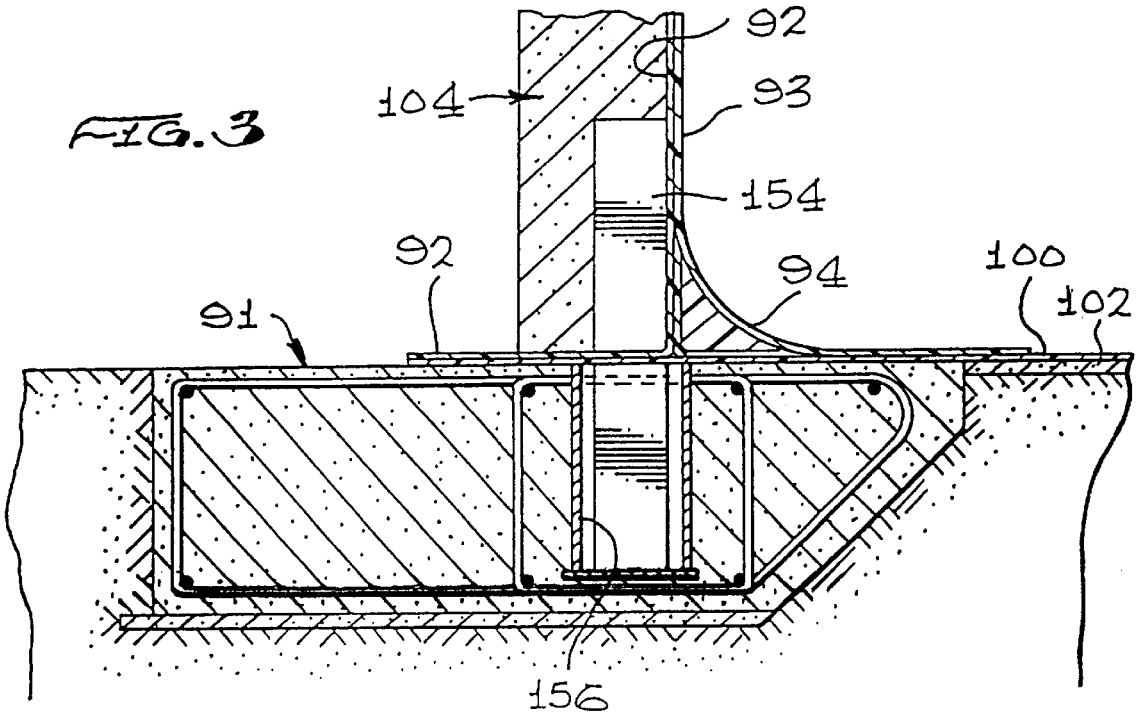
FIG. 3 shows a cross-section of the wall-floor-footing construction.

Turning now to the walls (104), as shown in FIG. 3, the floor lining (100), wall lining (106) and splice linings (93) form a combined membrane which is the inner layer of the tank. Outside this inner membrane—which lines the inside of the walls (106)—are layers of shotcrete, reinforcing steel and wrapping composite wall (104) (FIG. 3). Brochure 1293 entitled "Typical P.C. Machinery and Tanks" included in the Disclosure Statement and incorporated herein by reference shows the shotcreting in progress. More specifically shown in FIG. 51 this composite wall (104) consists of layers of shotcrete 104A, wrapped wire 104B and vertical reinforcing bars 104C. As also shown in FIG. 6C, the prestressed wrapping material (104B) used to prestress the walls (104) may initially be 5 mm diameter hot dipped galvanized high tensile wire. Other material which may be used is 5 mm (0.196") S-2 glass wire—wound on specially designed reels of 8 ft in diameter constructed to accommodate 65,000 feet of material per reel. Other types of prestressing, of course, can also be used.

We turn now to a description of prestressing machinery. That machinery—shown in FIG. 9 (commercially to be called the DYK 6)—consists of a motorized revolving tower (112) and a radial truss (114) which supports the radially rolling overhead carriage (122). A prototype of the DYK 6 machine may be seen in DYK-TECH's brochure 1293 entitled "Typical PC Machinery and Tanks" included in the Disclosure Statement and incorporated herein by reference. Radial truss (114) is connected on one side to revolving tower (112) and on the other side to a swivel (116) in the center of the tank which is supported by a cylindrical center tower (118) bolted to a 10 ft or larger diameter reinforced concrete slab (120). Carriage (122) moves in or out radially on the truss and is controlled electronically. Attached to the outside of this carriage (122) are extendible vertical posts (124 and 126)—driven up or down by electric motors—which are electronically controlled for their up or down movements. The swivel (116) permits simultaneous conveyance of concrete, mortar, water and compressed air by placing, compacting and finishing apparatus mounted on posts (124) and (126). Mounted on top of rolling tower (112) is a diesel driven generator (113) to provide power for light curing and electric motors. Inside the rolling tower is a wire wrapping assembly (122A) (such as that shown in U.S. Pat. Nos. 3,572,596; 4,302,978; 3,504,474; 3,666,189; 3,892,367 and 3,666,190 and in the 2-page color brochure No. 1293 entitled "Typical PC Machinery and Tanks" included in the Disclosure Statement and which are incorporated herein by reference.) Outside the tower (112) is a nozzle assembly such as that shown in brochure No. 1293 above but not shown in FIG. 9, which are electronically controlled as to raising and lowering. The rolling tower is supported by hydraulic wheel motors, the rotation of which are also electronically controlled, which cause the tower to roll around the tank and used, for example, in shotcrete applications, wire wrapping, light curing and concrete placement of the roof.

Figure 4:
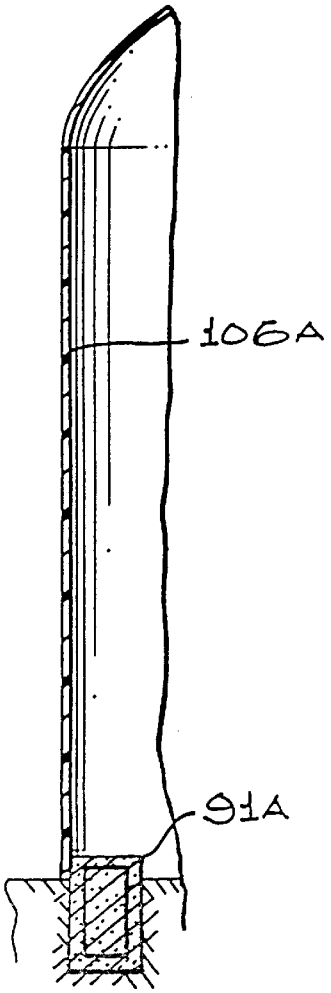
FIG. 4 shows a cross-section of the outer membrane and outer footing to which it is anchored.
Figure 6B:
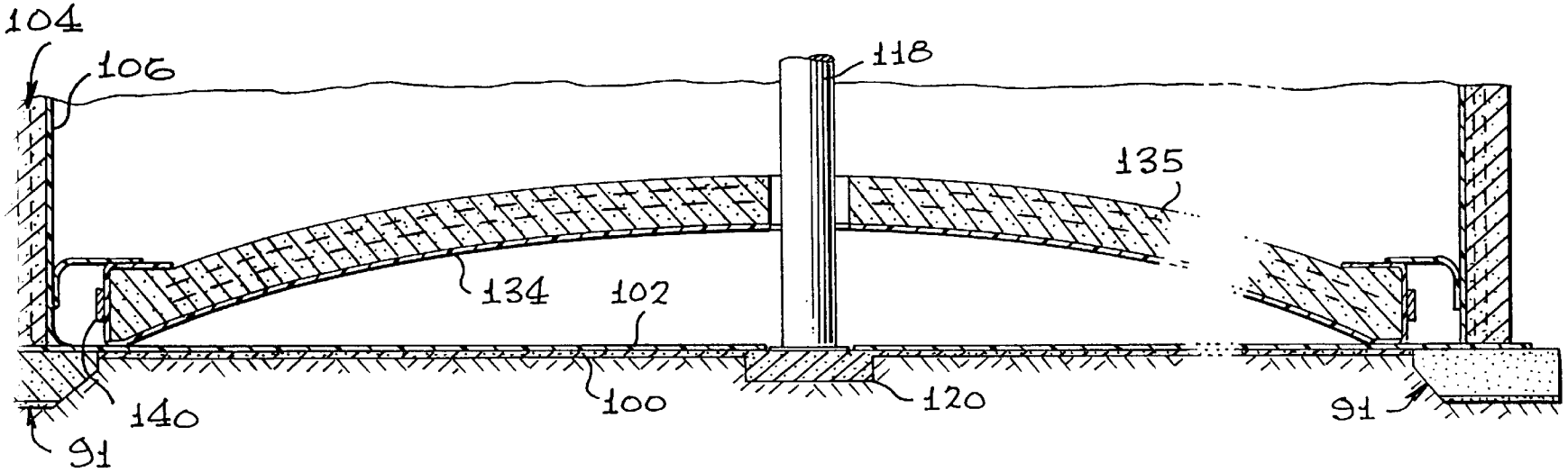
FIGS. 6A, 6B, and 6C show the dome in various stages of construction.
Figure 6A:
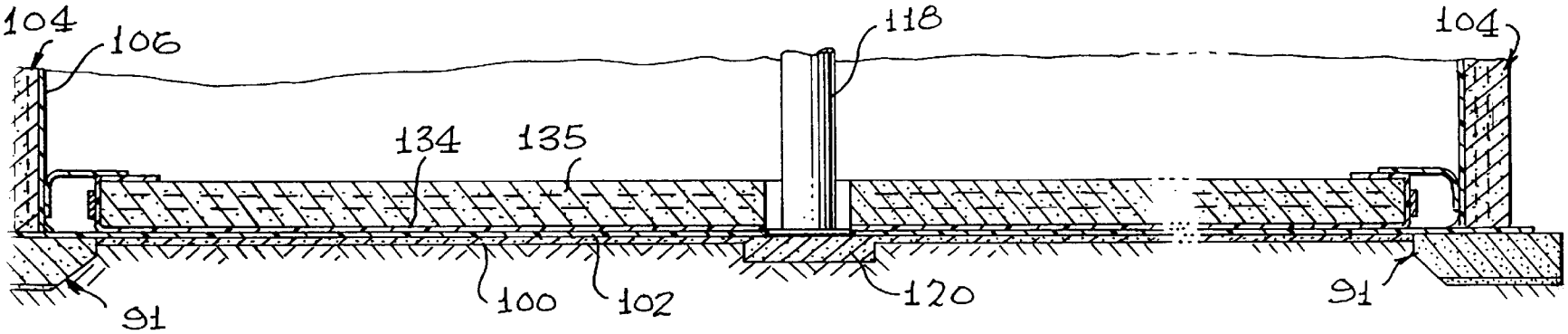
Figure 6C:
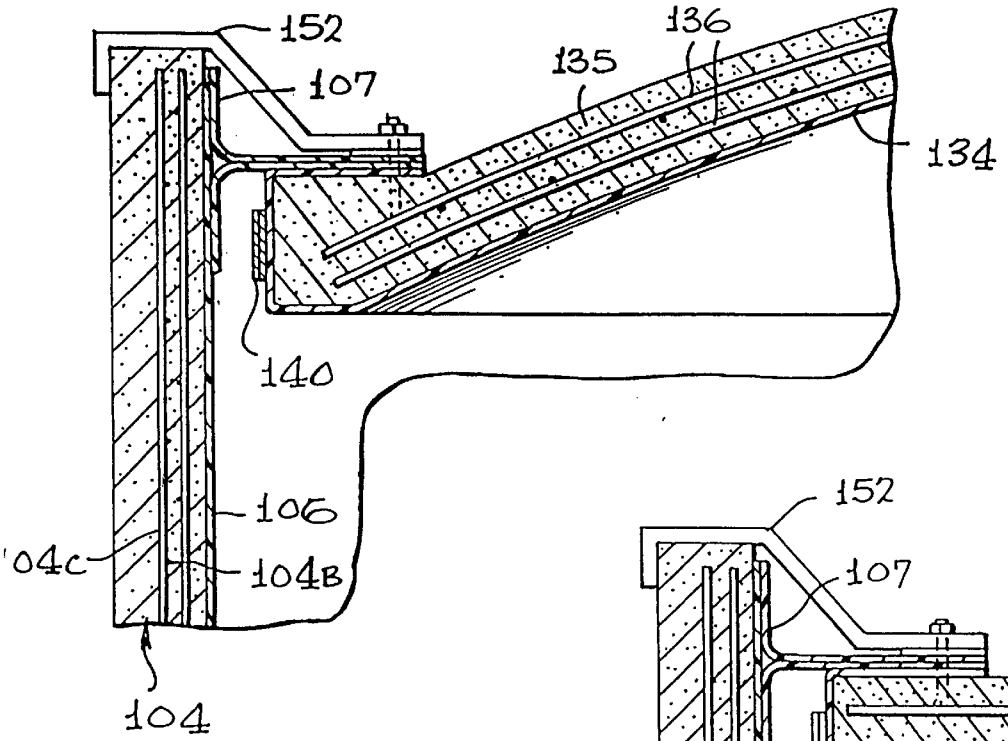
Figure 9:
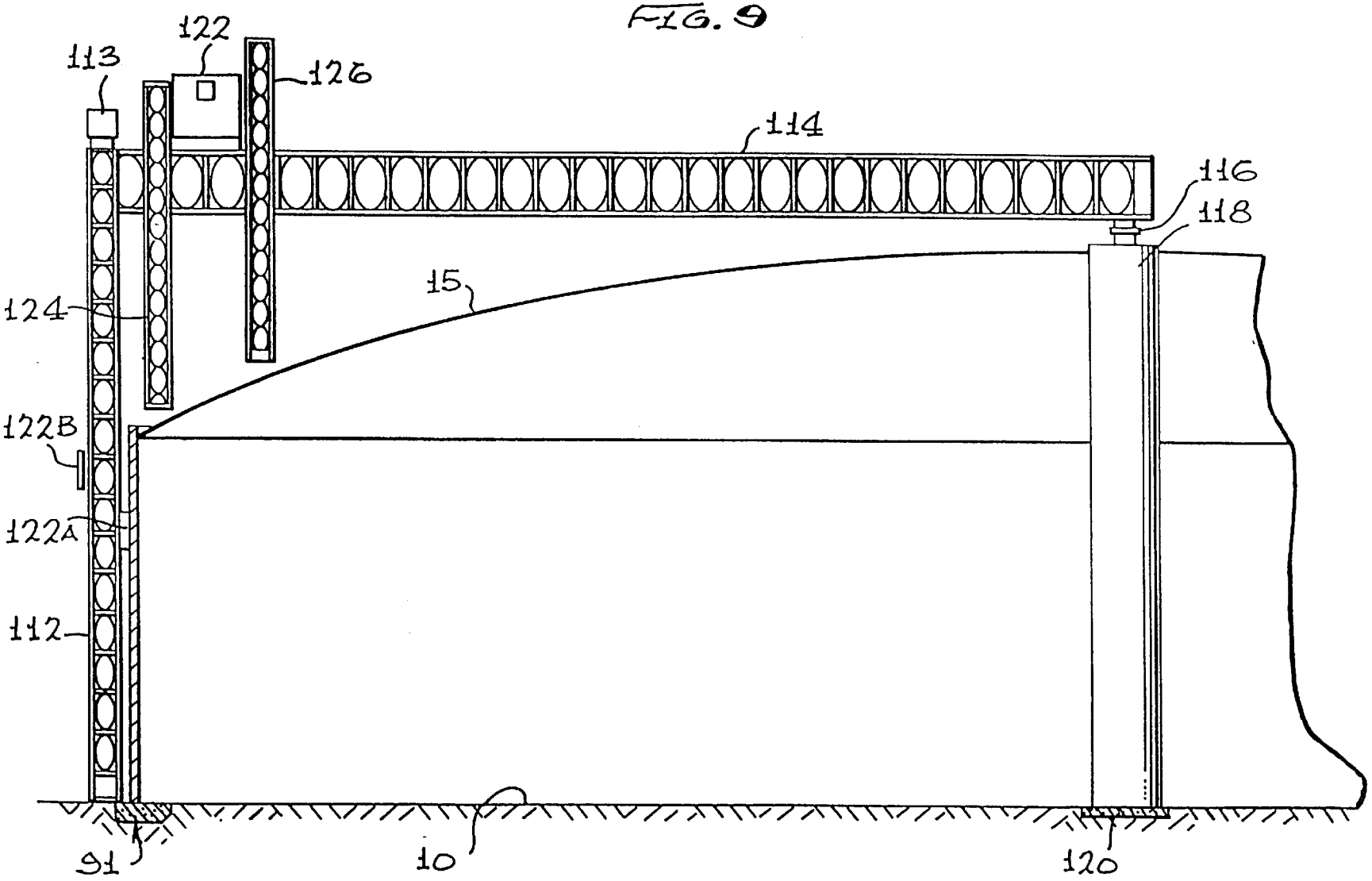
FIG. 9 shows a cross-section of wall and footing and a side view of the tank construction machinery required to build this new type of tank.

Turning now to the foundation, as illustrated in FIG. 3, the construction of the tank starts with preparing the pad or foundation starting with a compacted subgrade—meeting freeway subgrade standards—followed by the construction of a concrete footing (91), concrete leveling pad (102); and, as illustrated in FIGS. 6A, 6B and 9, a thickened center concrete slab (120) 10 ft in diameter (or larger), to support the center tower (118), which in turn supports the radial truss (114) and carriage (122) used for performing operations on the roof. FIG. 4 illustrates a typical outer footing 91A, to which is anchored an outer inflated membrane 106A which is used to protect and shield the construction of the tank from the elements. See U.S. Pat. Nos. 4,884,747, 4,879,959 which are incorporated herein by reference and also describe such outer membrane.

We now describe construction of the FRP floor. As shown in FIGS. 3 and 6A, the completion of the foundation is followed by the installation of the ¼" thick FRP floor (100) which, in the best mode, consists of 4 layers of light curable prepregs—reinforced with biaxial glass matt—which typically are delivered to the jobsite rolled up (carpet like) in a black polyethylene cover to prevent premature curing by daylight. While conventional FRP is cured by combining resins with promoters and catalysts, light cured resins are cured by UV (ultraviolet) rays available in sunlight and special conventional heatlamps such as used for skin tanning. These are then rolled out in continuous layers—for example, side by side in a North-South direction—with overlapping joints, and subsequent layers always retaining the top black polyethylene cover, until the next layer of prepregs is placed. The first layer of prepregs will have a black polyethylene cover on both sides to prevent, for example, the FRP from sticking to the concrete floor and footing and to facilitate the relatively small radial wall movements thereby tending to preserve the integrity of the wall-floor connection during; i.e., circumferential prestressing and fluctuating water depths. Upon completion of the rolling out of these "carpets", the prepregs are cut circumferentially to the desired radius followed by light curing. (See U.S. Pat. No. 5,094,044 issued to the subject inventor and application Ser. No. 08,076,261 filed Jun. 11, 1993 by the subject inventor, and information in the Disclosure Statement which are all incorporated herein by reference.) After the floor (100) of the tank has been light cured—generally within 24 hours—as shown in FIG. 6A, a second ¼" thick FRP layer or membrane (134) will be constructed—and light cured—on top of the FRP floor lining 100. What will become the inside liner of the dome (15), is constructed in the same manner as the floor (100) which was detailed earlier.

Figure 11:
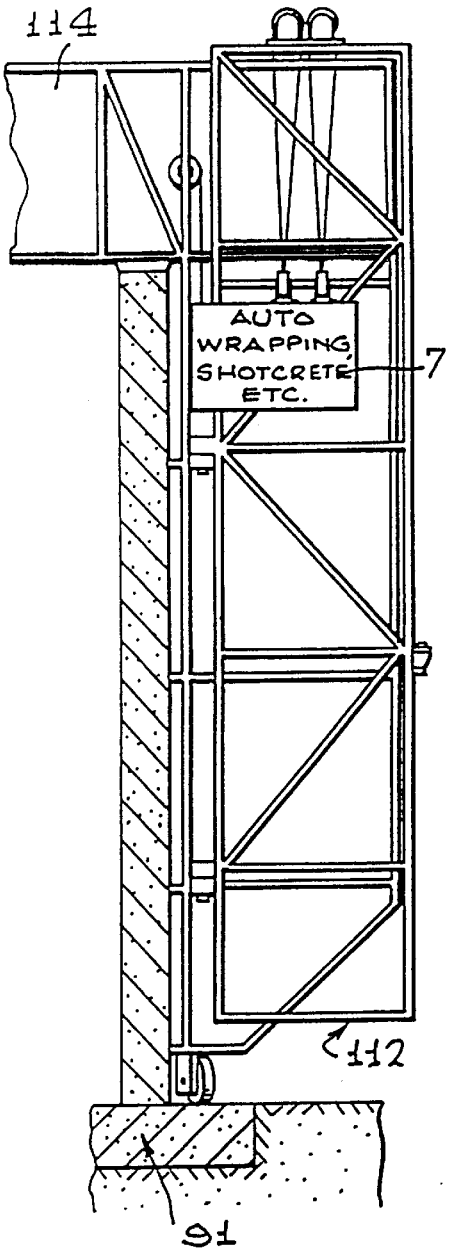
FIG. 11 shows a typical tower which revolves around the periphery of the tank structure on wheels or similar means and which allows the prestressing, shotcreting, light curing and other machinery to be utilized to construct the tank.

We now discuss the installation of the prestressing machinery. As shown in FIG. 6A, a center hole—somewhat larger than the outside diameter of the round center tower support 118—is then cut out of the two FRP linings (for both the floor (100) and the dome (15)) after which the center tower (118)—which supports the swivel (116)—is erected and bolted down to the 10 ft diameter reinforced concrete tower support slab (120), followed by the raising of the external rolling tower (112) which revolves on a circular pathway outside of what will be the walls. This is also shown in FIG. 11 and disclosed in U.S. Pat. No. 3,572,596 issued to the subject inventor. Radial truss (114) is then installed spanning tower (112) and center tower (118). Installation of the remaining components of the prestressing (DYK 6) machinery then follows. Brochure 1293 entitled "Typical PC Machinery and Tanks" authored by Mr. Dykmans and attached to the Disclosure Statement shows the prototype of this DYK 6 machine.

Construction of the FRP-PC dome can now take place. Simultaneous with the erection of the prestressing (DYK 6) machinery, work proceeds on the installation of the dome reinforcing (136) (see FIG. 6C) and concrete (135) (see FIGS. 6A & 6B) upon the dome lining (134).

Upon completion of the installation of the reinforcing steel (135), the concrete (136) is placed upon the dome lining 134, vibrated and screened in one continuous process—aided by conventional screeds and vibrators attached to posts 124 (2 each) and 126 (2 each) positioned on either side of carriage (122) on the radial truss (114), on the revolving DYK 6 machine (see FIG. 9). Concrete placement is facilitated by the system's ability to pump concrete through the swivel (116) to the discharge point on one of the leading post (126) adjacent to the carriage (122). The other posts (124) and (126) can be used to facilitate vibrating, screening and floating of the concrete. A retarding agent can be added to the concrete to sufficiently delay the concrete "set-up" time—which is the starting point of the concrete hardening process to allow the "inflation" of the membrane to create the dome. The FRP liner, when cured is an inflatable or flexible membrane capable of stretching and inflation. The inflation of the membrane and concrete thereon (shown in FIG. 6B) is accomplished with compressed air introduced by conventional means (not shown) between the dome membrane (134) and floor membrane (100)—until the slab has become a substantially spherical dome shell of the desired rise (See FIG. 6B). The concrete will then be re-vibrated, screeded and floated with the aid of the revolving DYK 6 machinery shown in FIG. 9. (See FIG. 6B) Where necessary the periphery of the membrane may be thickened or weighed to hold the edges of the dome membrane down, whereas the center is free to move up during the inflation process, to arrive at the desired shape of the dome.

Once the dome membrane (100) and concrete composite (135) has been raised to the desired shape, the dome concrete is now permitted to harden into what may be called a pre-fab dome structure as shown in FIG. 6B. Whereas smaller domes may have sufficient reinforcing without the need for additional circumferential prestressing, larger domes will require circumferential prestressing of the dome ring which may be done, for example, with FRP tape wrapping (140, see FIG. 6B), wound wire, or other prestressing material before the wall construction is started.

Figure 7:
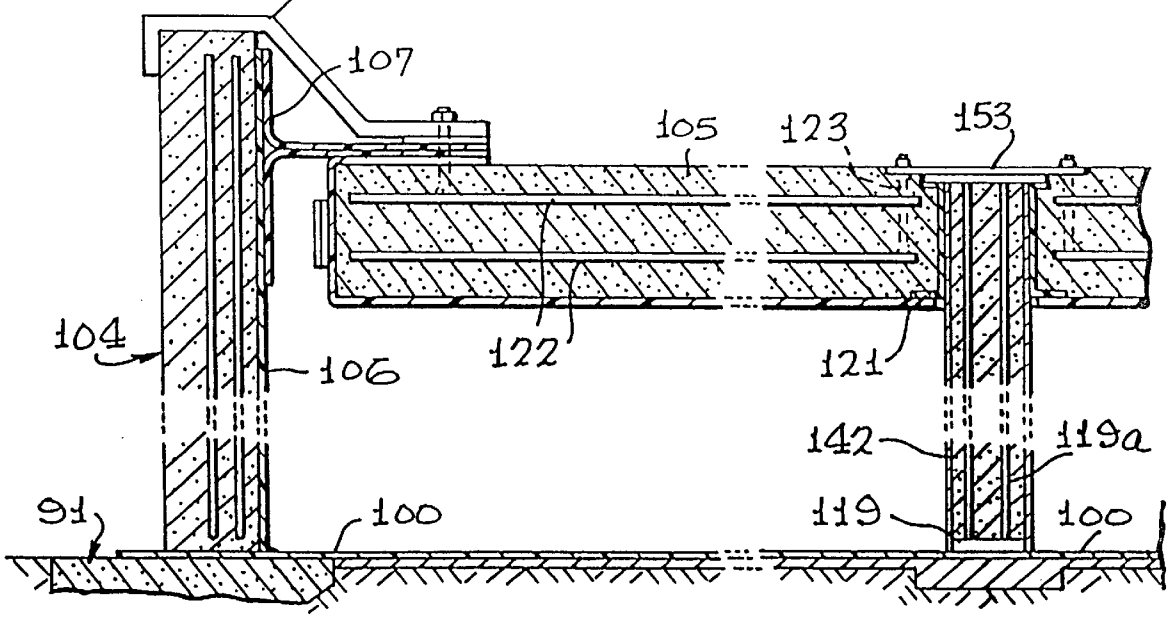
FIG. 7 shows a cross-section of a flat slab roof and column construction.

We now turn to the embodiment in FIG. 7, depicting a flat slab roof supported by columns. As with the dome-shaped roof, the work will start by constructing the FRP membrane on the floor (explained previously)—followed by cutting the center hole—the erection of the center support tower (118) and then the assembly of the rest of the (DYK 6) prestressing machinery. During erection of the (DYK 6) prestressing machinery, 1" thick FRP column location pads (119) are glued to the FRP floor lining (100)—followed by the installation of FRP column-roof connector rings (121)—the erection of the FRP column tubings or sleeves (142)—the gluing of the re-bar support blocks (123) (which also serve as FRP anchors to the concrete)—the installation of the reinforcing steel (122), and the pouring, screeding, vibrating and finishing of the concrete with the DYK 6 prestressing machine. The FRP column tubings (142)—which can be furnished in any transportable length in diameters to 16", are then plumbed, braced and then filled with reinforcing steel and concrete. They will harden into rigid columns **(119*a*)**

Figure 8:
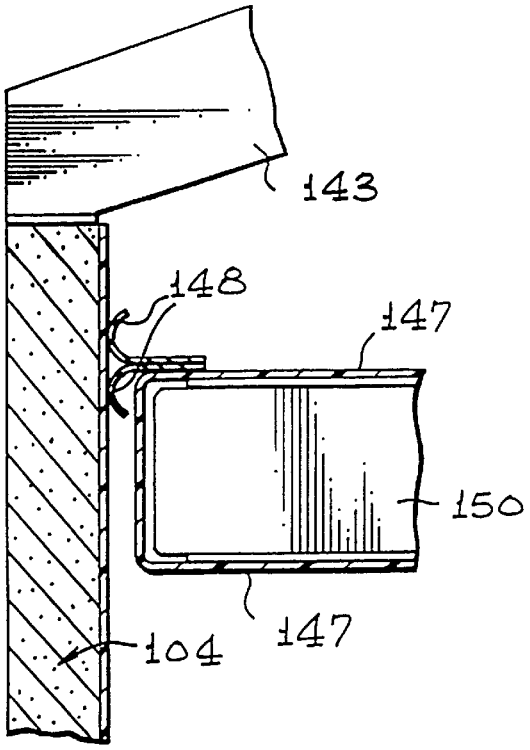
FIG. 8 shows a cross-section of a floating roof construction.

The subject invention contemplates a variety of roofs including a floating roof as shown in FIG. 8. The construction procedure of these roofs is similar to the flat slab roof of FIG. 7. The floating roof would have a PRP lining (147) enclosing a light-weight core 150. A double spring-loaded Teflon-coated neoprene seal (148) is used to contain liquid emissions and rain water which will be drained off through flexible hoses connected between the discharge points on the roof and the drain pipes coming through the floor.

The invention also contemplates using prefabricated FRP roofs of the type illustrated schematically in FIG. 8. Roof 143 is shown in phantom. These roofs would be trucked in and installed after the wall has been completed.

After the floor and dome have been constructed, attention will be given to building the walls of the tank. In a preferred embodiment as shown in FIG. 1, rigid prefabricated FRP wall forms (30) are first constructed. Preferably, they are 8 ft wide by 40 to 50 ft long and are extendible for greater liquid heights and adjustable for the desired wall radius. These wall forms will then be erected and braced to anchors in the concrete dome or flat slab concrete roof while they are still on the floor. The ¼" thick FRP wall membrane is constructed in a similar manner as the floor membrane except that the rolled-up "carpets" will be attached to the form at the top and rolled down to the footing. The wall membrane will then be light-cured in a spirally upward or downward motion around the tank with a bank of UV emitting lights—attached to the spray escalator on the DYK 6 machine.

Seismic anchors can be integrally constructed with the walls. Turning to FIG. 3 (and as also illustrated in the publication "the DYK 6 concept" provided with the Disclosure Statement), the connection utilizing seismic bars (154) does indeed reduce bending stresses in the wall as discussed earlier. These rectangular stainless steel bars (154) are solidly encased in the wall and are positioned in rectangular stainless steel cans (156) cast in the concrete footing. A close fit between the bars (154) and the radial walls of these cans (156) constrains these bars to be essentially prevented from moving circumferentially. (FIG. 10) On the other hand, there is ample room in these cans (156) to permit the bars (154) to slide freely in the radial direction inside these cans (156).

Figure 10:
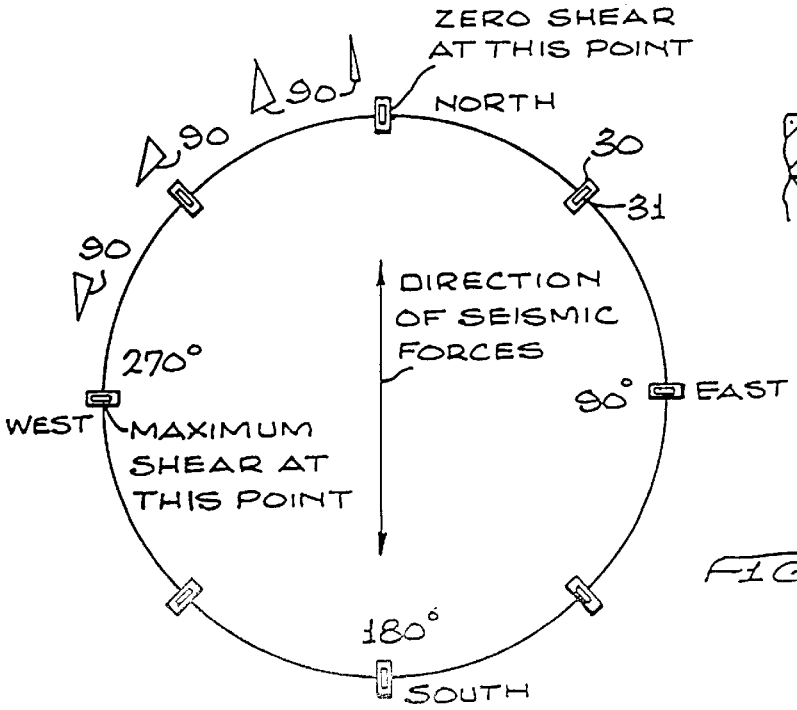
FIG. 10 shows the shear resistance pattern from the seismic anchors with the direction of seismic forces in the north-south direction.

For example, let one assume that seismic forces, are acting in the North-South direction. (See FIG. 10) Each N-S force acting on these bars is essentially the resultant of 2 forces: one radial and one circumferential. The radial components are the ones typically creating the vertical bending moments in the wall, so the goal is to minimize these radial forces. This is accomplished by permitting the seismic bars (154) to move freely in the radial direction. That leaves the circumferential component to contend with. As shown in FIG. 10, the magnitude of these circumferential forces change with either the sine or the cosine of the angle between the radial direction of these cans and the N-S line or the E-W line. See U.S. Pat. Nos. 5,177,919 and 5,105,590 on the subject issued to the subject inventor and incorporated herein by reference. Thus, for a N-S seismic direction load—the maximum circumferential forces develop on the true East and West points gradually reducing to zero at the true North and South points. The sum of all the North-South components on these bars equal the seismic force acting on the tank.

Figure 5:
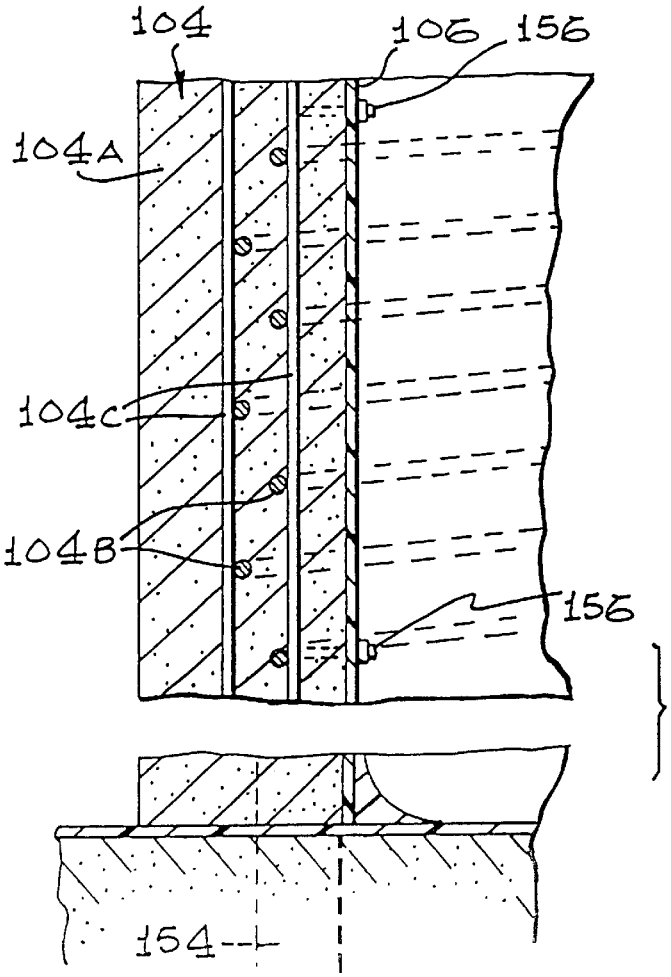
FIG. 5 shows a typical wall section and partial view of the inside wall surface; also showing the seismic bars extended into the wall footing.

We now turn to FIGS. 3 and 5, to analyze the wall construction upon completion of the FRP floor (100), vertical re-bar supports (105) (See FIG. 5) will be attached to the FRP lining (106) which can be shaped in a manner that they will also serve as mechanical anchors of the lining to the wall. This will, be followed by installation of multiple layers of vertical re-bars (104C), pneumatic mortar (104A) and wire wrapping (104B). (See FIG. 5) The pneumatic mortar application is a continuous process, accomplished by the (DYK 6 Machinery revolving around the perimeter of the structure similarly as shown in brochure 1293. The material is applied in a spiral motion—either going up or down by apparatus contained in the carriage 122 which for this purpose is raised and lowered on the outside of rolling tower 112. Mortar and compressed air is pumped by conventional means from the ready mix truck (also shown in brochure 1293) and compressor (not shown-adjacent the ready mix truck) through separate hose lines which are run, first under the floor and then come up through the circular center slab, up the central tower 118, through the swivel (116) (see FIG. 9)—then moving radially on radial truss 114 to the vertical tower (112) where they connect to the nozzle on the spray escalator 122B. In cold regions of Canada and Alaska or where necessary polyurethane insulation can be sprayed on the exterior wall surface to minimize the differential temperature effect. Likewise, a barrier of polyurethane insulation can be installed between the inside wall membrane and the wall composite when hot liquids will be stored inside the tank. Another way to overcome large temperature differentials would be to bury the tank in the ground.

Stripping of the wall forms can start before the wall construction has been completed after sufficient wall thickness has been built up to withstand wind pressures without the assistance of the form support.

After the walls have been constructed, the stage is set for raising of the dome—or flat roof—with compressed air to its final position. This will start immediately after the circular wall (104) has been completed. In a preferred embodiment, to avoid ripping of the roof, the air pressure will be kept somewhat below what is needed to raise the roof. The remainder force may be provided by a series of small winches placed at equal distances around the circumference of the roof and at each column. They will be regulated in a manner that the roof will be raised evenly in a controlled manner. In its final position, support brackets (152) (see FIG. 6C and 7) will be installed and a FRP closure connection (107) is made between the upper wall lining and the FRP inside roof lining. In one embodiment, the flat roof (105) (see FIG. 7) is further supported by stainless steel support plates (153)—resting on FRP seal plates on top of the columns—which are bolted to anchor bolts in the concrete slab of flat roof (105), around each column. Subsequently the air pressure is released.

A pre-fabricated FRP ventilator (not shown) may then be installed after the center tower (118) has been removed. At the same time the center hole in the floor is closed with a FRP plate adequately overlapping the floor while appropriate connections being made to accommodate protruding pipe.

FRP staircases or ladders can then be attached to the outside wall surface. Flanged pipe nipples for inside or outside pipe connections can be installed in the wall or dome. Whenever possible it would be better to install all supply, discharge, scour, overflow and redundant pipes (for possible future use) under the floor—entering the tank floor in pre-planned locations—preferably—where possible—in the center slab area of the tank.

In another preferred embodiment, the tank may be analyzed 3-dimensionally with a finite element program. In the structural analysis, the wall cylinder and the dome shell are considered a composite consisting of layers of concrete, steel and FRP as detailed in the right hand bottom corner of photos 1 to 16 of the Dyk 6 Concept color brochure filed with the Disclosure Statement. Each layer of this composite can be analyzed for the stresses and deformations developed in that layer which can be presented graphically and in color in the form of stress contours and deformation curves including pin pointed locations of the maximum and minimum stresses, which is depicted in preliminary form in the Dyk 6 Concept brochure.

The tank analysis may consider the following stress and deformation causing conditions—including buckling—for tank empty and tank full conditions:

1. prestressing during and after wrapping;
2. internal liquid loads—static and dynamic (seismic);
3. uniform and asymmetrical backfill pressures on the wall—static and dynamic;
4. snow and other roof live loads—static and dynamic;
5. wind loads on roof and wall—both pressure and suction;
6. differential summer temperatures—aggravated by differential sun temperatures;
7. differential winter temperatures.

Again, the referenced Dyk 6 Concept brochure (See Disclosure Statement), shows, in color, the maximum, shotcrete compression in the wall without consideration of temperature differential conditions in contrast when winter temperature and snow loads are taken into account. Note the difference in compression of 925 psi versus 1,345 psi. This brochure also shows the result of no summer differential temperature allowance. Compare the steel tension in the wall with that in photo 4 where summer differential temperature has been allowed. Note the difference in steel tension of 10,472 psi versus 20,881 psi. Summarizing the brochure, which because it is in color might be more informative than the drawings, photo 5 shows a compressive stress of 423 psi in the dome without summer temperature differentials whereas photo 6 shows a compressive stress of 1,345 psi when differential temperatures—sun included—are allowed for. Photo 7 shows a steel tension of 12,780 psi if no winter temperature differential has been allowed whereas photo 8 shows a steel tension of 21,760 psi when winter temperature differential and snow loads are allowed for. Photo 9 shows the wall buckling factor of 12.07 when no temperature differential has been allowed whereas photo 10 shows a buckling factor of 2.2. for summer differential temperature—sun included—has been allowed whereas photo 11 shows a buckling factor of 2.1 when winter differential temperature and snow load have been allowed. A buckling factor of 2 essentially means a safety factor of 2. Photo 12 shows the differential surface temperatures generated by the sun on dome and wall.

Also, for example with regard to seismic disturbances, the walls of the structure are free to move in or out in the radial direction allowing the structure to distort substantially into an oval shape thereby minimizing bending moments in the wall. This effect may be seen in photos 13, 14, 15 and 16 of the Dyk 6 Concept brochure. In photos 13 and 15, the "Base Restraint is Radial—Free and Circumferential-Locked." In photos 14 and 16, the "Base Restraint is Radial-Locked after full prestress and Circumferential-Locked." The difference in steel stress is 20405 psi in photo 13 and 34,224 psi in photo 14. The difference in shotcrete compression is 260 psi in photo 15 and 1,382 psi in photo 16. Thus, when a seismic disturbance occurs, the force acting on the structure can be designed to be transmitted and distributed to the footing parallel to and around the circumference of the tank.

A sun temperature—applied at right angles to the surface—can be assigned a certain value over and above the air temperature. A realistic figure would be 50 D.F. This assumption was used in the case of photo 12 in the Dyk 6 Concept brochure reference the yellow letters in the white border line area in the top left area of the photo. If the sun position to that surface is less than 90 degrees, one could use the sine value of the angle between the sun and the surface under consideration. The analysis of the tank takes into account the direction of the sun to the vertical line of tank revolution (see photo 12 upper middle area), the N-S-E-W coordinates and the relative angle of the sun to each wall, roof or floor element—whether the sun shines on the outside surface of covered tanks or on the inside and outside surface of open top tanks. Furthermore—since concrete cannot take tensile stresses—they are automatically zeroed out when they develop at any point to insure true tensile stresses in the reinforcing steel. Page 1 of brochure 0794, attached to the Disclosure Statement, offers attractive cost data and construction times for 50 year rated open top and fixed dome roof tanks. Reference the comparisons on page 2 of brochure 0794, these costs do not only compare favorably with carbon steel tanks—they are also substantially lower than RC and PC tanks.

Thus, an improved dome structure is disclosed. While the embodiments and applications of this invention have been shown and described, it would be apparent to those skilled in the art that many more modifications are possible without departing from the inventive concepts herein. The invention therefore is not to be restricted except in the spirit of the appended claims.

I claim:

1. The process of constructing a substantially cylindrical tank on a base, comprising:

(a) constructing a composite roof of a desired shape and purpose on said base;

(b) installing a substantially vertical composite wall around said roof on said base;

(c) providing a substantially effective seal between said roof and said composite wall; and (d) raising said roof in relation to said base to its final position and connecting it to said wall.

2. The process of claim 1 including the step of supporting said roof with supporting means.

3. The process of claim 2 in which said supporting means are at least in part connected to the wall.

4. The process of claim 3 in which said supporting means have the additional ability to distribute seismic forces radially and parallel to the wall in a manner that the radial forces are minimized.

5. The process of claim 2 in which said supporting means are at least in part columns.

6. The process of claim 5 including the step of adding additional air seals attached to the roof placed around each supporting column.

7. The process of claim 5 in which said supporting columns have at least in part an outside monolithic lining.

8. The process of claim 7 in which said supporting columns have at least in part an inner monolithic lining connected to outside monolithic lining.

9. The process of claim 8 in which said inner and outer monolithic linings are at least in part an air or liquid tight membrane.

10. The process of claim 9 in which said membrane is fiber reinforced plastic.

11. The process of claim 10 in which said fiber reinforced plastic is at least in part light cured resin.

12. The process of claim 10 in which said fiber reinforcing is at least in part steel.

13. The process of claim 10 in which said fiber reinforcing is at least in part synthetic.

14. The process of claim 2 in which said supporting means is liquid.

15. The process of claim 2 in which said supporting means is compressed air.

16. The process of claim 1 including the step of connecting said wall to said base with seismic anchors capable of distributing seismic forces radially and parallel to the wall in a manner that the radial forces are minimized.

17. The process of claim 1 including constructing said tank inside an outer air inflated membrane for weather protection.

18. The process of claim 1, in which said tank has a monolithic inside lining covering said base, wall and roof.

19. The process of claim 1 including constructing said tank with revolving machinery and a center support tower.

20. The process of claim 19 in which the center support tower and roof include a substantially air tight connection to facilitate the lifting of said roof with air.

21. The process of claim 20 in which said center support tower is cylindrical with a relatively smooth closed surface.

22. The process of claim 21 including the adding of an additional air seal between said roof and said center support tower.

23. The process of claim 1 in which said composite wall is at least in part prestressed.

24. The process of claim 23 in which said prestressing is at least in part circumferentially wrapped.

25. The process of claim 24 in which said circumferential wrapping is at least in part wire or tape.

26. The process of claim 25 in which said wire or tape is at least in part steel.

27. The process of claim 25 in which said wire or tape is at least in part synthetic.

28. The process described in claim 23 whereby sufficient prestressing is applied to said substantially cylindrical tank to limit FRP tensile stresses to acceptable levels under all loading conditions.

29. The process described in claim 23 whereby prestressing is applied by continuous electro servo tensioning means to maintain stress levels within a certain designed stress tolerance.

30. The process described in claim 23 whereby prestressing is applied to said substantially cylindrical tank by FRP tape wrapping.

31. The process of claim 1 including determining the parameters of said cylindrical tank by analyzing 3-dimensionally for all applicable internal and external loads, including, but not limited to, seismic, liquid, differential temperature, differential sun generated surface temperatures, point loads and asymmetrical backfill.

32. The process in claim 1 in which said desired shape is either flat, curved, spherical, conical or a combination of these.

33. The process of claim 1 in which said cylindrical tank is at least in part lined with a suitable insulation material to minimize temperature differences between inside and outside surfaces.

34. The process of claim 1 including the step of using revolving machinery to construct said structure requiring a center support tower.

35. The process of claim 34 in which said center supporting tower includes a multi-port swivel permitting the simultaneous conveyance of materials, liquids or air.

36. The process of claim 34 in which said revolving machinery includes wrapping means for circumferential prestressing purposes.

37. The process of claim 36 in which said wrapping means include wire and tape wrapping means.

38. The process of claim 37 in which said wire wrapping means include electronic wire spacing means.

39. The process of claim 37 in which said wire and tape wrapping means include accurate automatic electronic tensioning and recording means of applied forces.

40. The process of claim 34 in which said revolving machinery includes spraying means for shotcrete, paint or insulation.

41. The process of claim 40 in which said spraying means includes electronic spacing means.

42. The process of claim 34 in which said revolving machinery includes UV-light curing means.

43. The process of claim 42 in which said UV-light curing means includes electronic spacing means.

44. The process of claim 34 in which said revolving machinery includes a rolling tower, and an operator cabin on the rolling tower that is vertically adjustable to any desired elevation.

45. The process of claim 34 in which said revolving machinery includes a rolling tower, a horizontal truss spanning between the rolling tower and the center support tower, and an operator cabin located on the horizontal truss that is radially adjustable to any desired radius from the center of the tank.

46. The process of claim 34 in which said revolving machinery includes power application means.

47. The process of claim 46 in which said power application means includes hydraulic drive means.

48. The process of claim 46 in which said power application means includes electric generating means.

49. The process of claim 34 in which said revolving machinery includes concrete placing, vibrating and finishing means.

50. The process of claim 1 wherein said desired shape is a substantially flat plate.

51. The process of claim 50 in which said flat plate is internally supported by columns.

52. The process of claim 50 in which said flat plate is internally supported by columns and is at least in part supported at its perimeter by the wall.

53. The process of claim 1 wherein said desired shape is substantially spherical.

54. The process of claim 1 wherein said desired shape is substantially conical.

55. The process of claim 1 including the step of determining differential temperature stress in said composite wall and roof resulting from sun generated temperatures calculated as a function of the sine value of the angle between the sun ray and the plane of the surface on which the sun shines, multiplied by the temperature of the surface created by the sun when the sun is normal to that surface.

56. The process of claim 1 wherein said desired shape is curved but neither spherical nor conical.

57. The process of claim 1 with the additional step of allowing said rigidifying material to set sufficiently for it to maintain said desired shape.

58. The process of claim 1 with the additional step of construction the wall of a desired height.

59. The process of claim 1 with the additional step of increasing the air pressure under said composite roof of desire shape and purpose to raise said composite roof to a predetermined height.

60. The process of claim 59 with the additional step of supplementing the air pressure with mechanical raising means to raise the composite roof of desired shape and purpose to a predetermined height.

61. The process of claim 60 with the additional step of fastening the composite roof of desired shape and purpose to the walls.

62. The process of claim 1 with the additional step of installing insulation where needed to keep differential temperature stresses within acceptable limits.

63. The process of claim 1 in which said composite wall is at least in part reinforced shotcrete or concrete.

64. The process described in claim 63 including the added step of adding necessary reinforcing steel to the composite wall resulting from zeroing out concrete or shotcrete tensile stresses using a three-dimensional finite element analysis procedure to ensure adequate reinforcing steel in the composite wall and to keep all steel within acceptable stress levels under all combinations of stress causing load conditions.

* * * * *